US008550309B2

(12) United States Patent
Flick

(10) Patent No.: US 8,550,309 B2
(45) Date of Patent: Oct. 8, 2013

(54) MOLDED FLUID DISPENSER FOR A NON-PRESSURIZED CONTAINER

(76) Inventor: Conrad Flick, Bettendorf, IA (US)

( * ) Notice: Subject to any disclaimer, the term of this patent is extended or adjusted under 35 U.S.C. 154(b) by 20 days.

(21) Appl. No.: 13/300,279

(22) Filed: Nov. 18, 2011

(65) Prior Publication Data

US 2012/0125953 A1 May 24, 2012

Related U.S. Application Data

(60) Provisional application No. 61/416,646, filed on Nov. 23, 2010.

(51) Int. Cl.
*B65D 37/00* (2006.01)
*B67D 3/00* (2006.01)
*B67D 7/06* (2010.01)

(52) U.S. Cl.
USPC ..... 222/207; 222/536

(58) Field of Classification Search
USPC ..... 222/536, 207, 214, 526, 527, 528, 222/529, 530, 533, 537
See application file for complete search history.

(56) References Cited

U.S. PATENT DOCUMENTS 3,104,786 A * 9/1963 Sanchis ..... 222/481
3,162,333 A * 12/1964 Davidson ..... 222/207
3,181,743 A * 5/1965 Libit et al. ..... 222/528
3,285,477 A * 11/1966 Marona et al. ..... 222/213
3,300,099 A * 1/1967 Marona ..... 222/207
3,820,689 A * 6/1974 Cocita ..... 222/207
4,216,880 A * 8/1980 Drelichowski ..... 222/83
4,732,303 A * 3/1988 Wang ..... 222/484
5,332,131 A * 7/1994 Pehr ..... 222/505
5,392,968 A * 2/1995 Dark ..... 222/529
5,505,341 A * 4/1996 Gueret ..... 222/207
5,875,936 A * 3/1999 Turbett et al. ..... 222/207
5,884,793 A * 3/1999 Wang ..... 215/389
5,894,960 A * 4/1999 Rodden et al. ..... 222/207
6,079,589 A * 6/2000 Matsuyama et al. ..... 220/715
6,161,728 A * 12/2000 Dark ..... 222/83
6,390,341 B1 * 5/2002 Ohmi et al. ..... 222/536
6,923,337 B2 * 8/2005 Hession et al. ..... 220/714
6,991,126 B2 * 1/2006 Jackel ..... 220/259.1
7,357,335 B2 * 4/2008 Laidler et al. ..... 239/302
2007/0051727 A1 * 3/2007 Holley ..... 220/367.1
2008/0156829 A1 * 7/2008 Chen ..... 222/207
2009/0071982 A1 * 3/2009 Lasfargues ..... 222/207
2010/0327019 A1 * 12/2010 Nilsson ..... 222/214

* cited by examiner

*Primary Examiner* — Paul R Durand
*Assistant Examiner* — Benjamin R Shaw
(74) *Attorney, Agent, or Firm* — Bradford E. Kile; Kile Park Reed & Houtteman PLLC

(57) ABSTRACT

A disposable molded dispenser for a non-pressurized container capable of dispensing a variety of fluid materials having a deformable spout chamber with an integral outlet valve through which fluid is expelled as the spout is selectively depressed compressing the chamber. A molded inlet valve serves to permit fluid to be pushed by ambient air pressure from a container into the spout chamber when pressure on the spout is removed and the spout chamber is restored to an initial configuration.

21 Claims, 9 Drawing Sheets

MOLDED FLUID DISPENSER FOR A NON-PRESSURIZED CONTAINER

CROSS REFERENCE TO RELATED APPLICATION

This application claims the priority of applicant's U.S. Provisional Application Ser. No. 61/416,646, filed on Nov. 23, 2010. The content of applicant's Provisional Application is hereby incorporated by reference as thought set forth at length.

BACKGROUND OF THE INVENTION

Field of the Invention

The present invention relates to a device for dispensing fluid material from a non-pressurized container. More particularly, the invention relates to a dispenser for liquids and gels from a non-pressurized container configured preferably from a single molded piece operable to be secured to the container body with an over-cap, ring or bayonet lock. Moreover the dispenser spout itself with molded internal inlet and outlet check valves functions as an operational pump. This enables efficient, cost effective manufacture from a single mold material. In addition, use of a single material enhances recycling considerations. The inexpensive nature of a integral molded dispenser enables the dispenser to be inexpensively produced and is thus disposable. In one preferred embodiment the dispenser head and a container retaining ring can be molded in one piece with a single molding operation The use of conventional pump action devices for dispensing fluid, flowable materials from a non-pressurized container has been known for years. With the rising popularity of pump-dispensed products on the market, consumers have grown to expect this convenience. Multiple part pump dispensers, however, tend to be somewhat expensive to manufacture and often constitute the highest cost component of a store ready product. Moreover dispensers combining plastic and metal components or different compositions of plastic impede recycling efforts.

Most conventional dispensers utilize a compressible fluid chamber in cooperation with pressure responsive supply and discharge check valves to define a fluid pathway between a non-pressurized container and a fluid outlet. The reverse action of the two check valves, one opening as the other is closing, cooperate with a compressing and then expanding chamber to establish a pump action.

One previously known dispenser comprises a disposable spout affixed to a hollow, cylindrical plunger axially sliding into a receiving, complementary accumulator with integral discharge and supply one-way check valves. This assembly communicates with a pick-up tube for material retrieval from the container. In operation a user depresses a finger spout, substantially reducing the pump chamber internal volume, to expel its contents under pressure through a one-way outlet valve in the spout. When released, a helical spring returns the chamber back to a pre-compressed volume creating a vacuum that induces a flow of more dispensable material through the one-way inlet valve. The dispenser is once again ready.

Other types of finger or palm action dispensing pumps utilize resiliently biased, deformable elements to provide compressible pumping chambers. These elements may be simple dome-shaped walls, or foldable bellows used in conjunction with a series of single directional check valves to create pumps. The mechanics of such devises to return to a pre-compressed state relies on a biased nature of plastic, and in some instances assistance from a metal spring. Though these designs utilize fewer components, they require assembly with leak concerns as most snap together, require gluing, or some form of heat welding. Some versions involve difficult molding techniques—such as over-molding. Although dissimilar materials can be used to achieve a resiliently deformable portion abutting a rigid structural base element along a seam this elevates mold and molding costs and involves secondary assembly steps and makes recycling problematic.

The drawbacks of these and other similar designs are the consequential costs associated with manufacture and assembly of several components in the past. In addition a dissimilarity of materials makes recycling less efficient or unacceptable. The subject one piece molded fluid dispenser can be produced for a fraction of the cost of multi-part pump action dispensers, is disposable and can be facially recycled and green friendly.

The relatively expensive nature of prior art assemblies renders them less disposable. This is apparent from the widespread availability of "refills" for many dispensers. Reuse of the dispensers, however, can become problematic due to exposure to environmental contaminants. This is of special concern in hygienic environments such as research labs and medical theatres. Disinfecting and refilling of the devices and storage of the dispensing materials becomes a cost issue.

Although previously known hand action pumps have received considerable attention, it would be highly desirable to provide a pump which could be cheaply molded from a single piece, easy to use, inexpensive to manufacture, recyclable, and adequate to accommodate various dispensable materials.

The difficulties and limitations suggested in the preceding and desired features are not intended to be exhaustive but rather are among many which may tend to reduce the effectiveness and user satisfaction with prior finger or palm action fluid dispensing pumps. Other noteworthy problems and limitations may also exist; however, those presented above should be sufficient to demonstrate that fluid dispensing pumps appearing in the past will admit to worthwhile improvement.

BRIEF SUMMARY

A preferred embodiment of the invention which is intended to address concerns and accomplish at least some of the foregoing objectives comprises a dispenser capable of being disposable and dispensing a variety of fluid materials. In a preferred embodiment the dispenser has a resiliently biased, deformable chamber with an integral outlet valve through which fluid is expelled as a spout is selectively depressed compressing the spout chamber. An integral inlet valve serves to permit fluid to be pushed by ambient air pressure from a container into the spout chamber when pressure on the spout is removed and the chamber is restored to an initial open configuration.

DRAWINGS

Other objects and advantages of the present invention will become apparent from the following detailed description of preferred embodiments thereof taken in conjunction with the accompanying drawings wherein.

Figure 1:
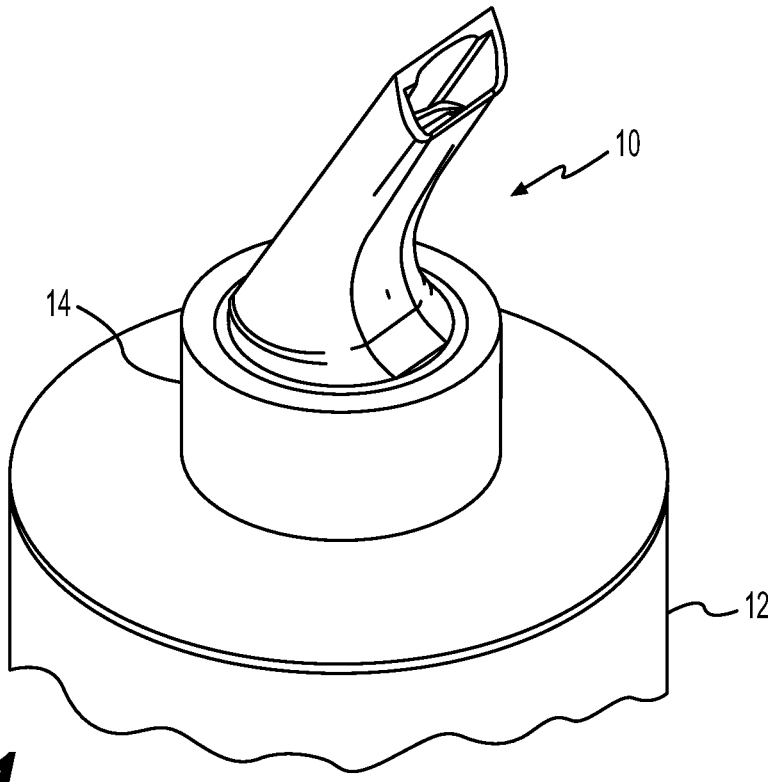
FIG. 1 is an axonometric view of a molded dispenser in an open posture in accordance with one embodiment of the subject invention.
Figure 2:
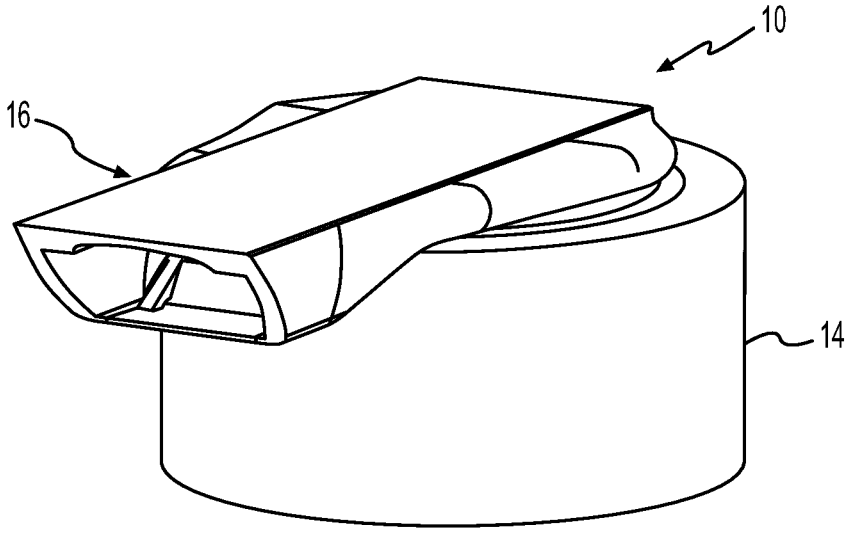
FIG. 2 is an axonometric view of the subject invention in a closed state for storage or on the shelf sale.
Figure 3:
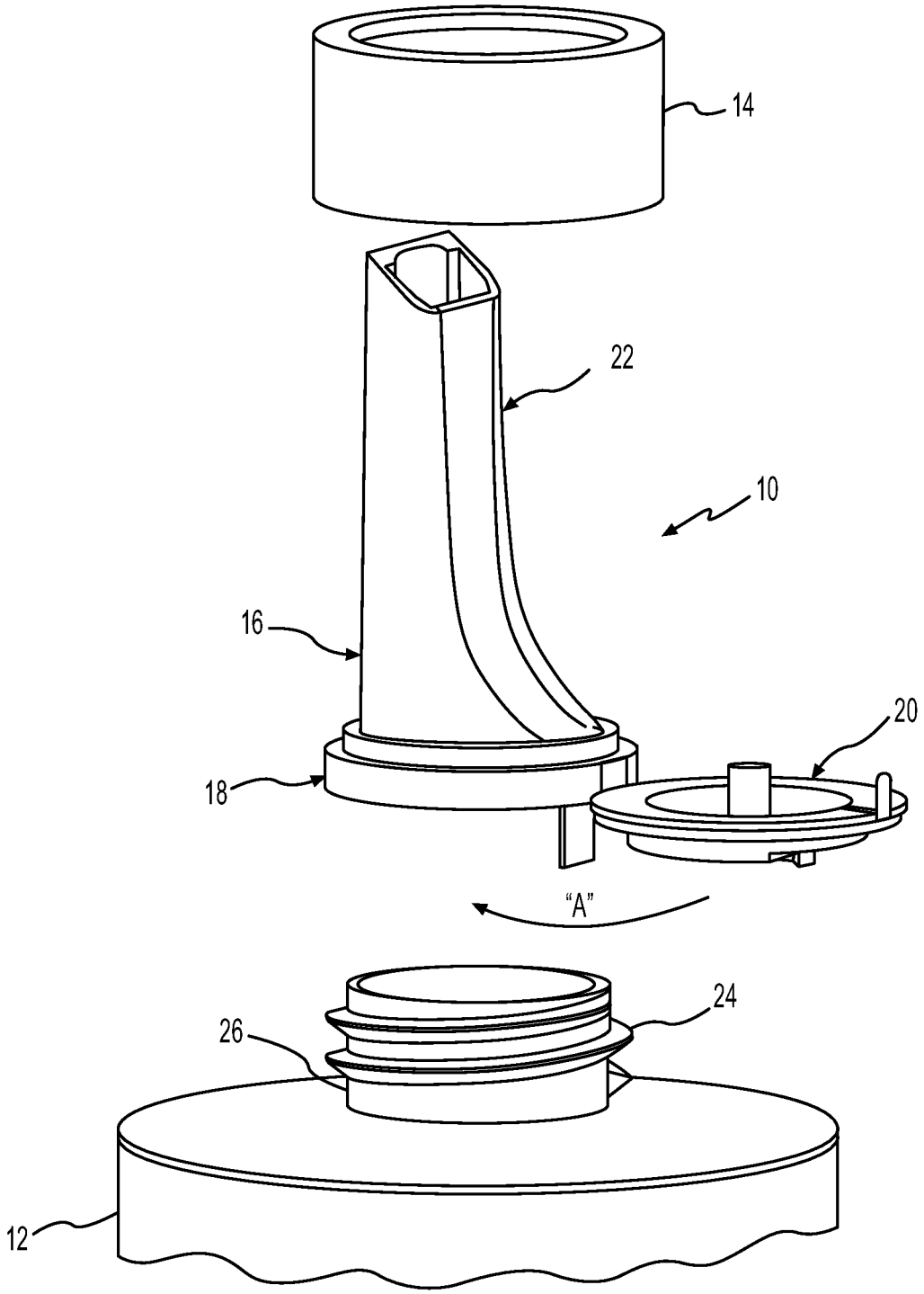
FIG. 3 is an expanded view of the embodiment shown in FIGS. 1 and 2 in an as molded state.
Figure 4:
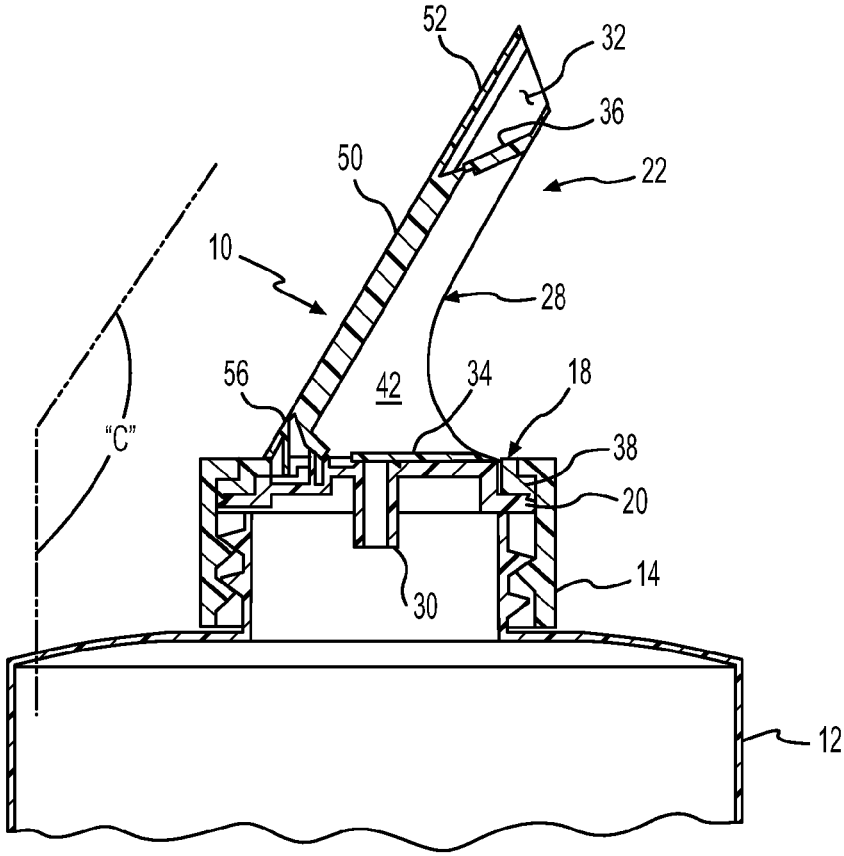
Figure 5:
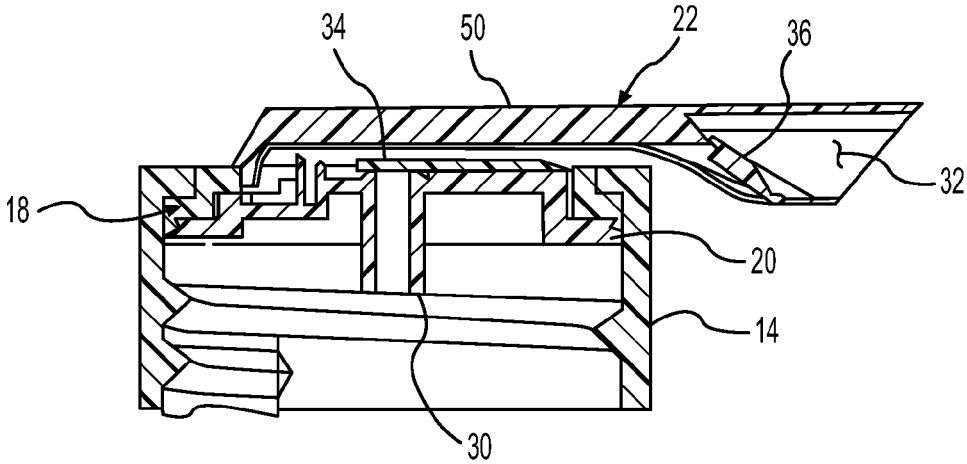
Figure 6:
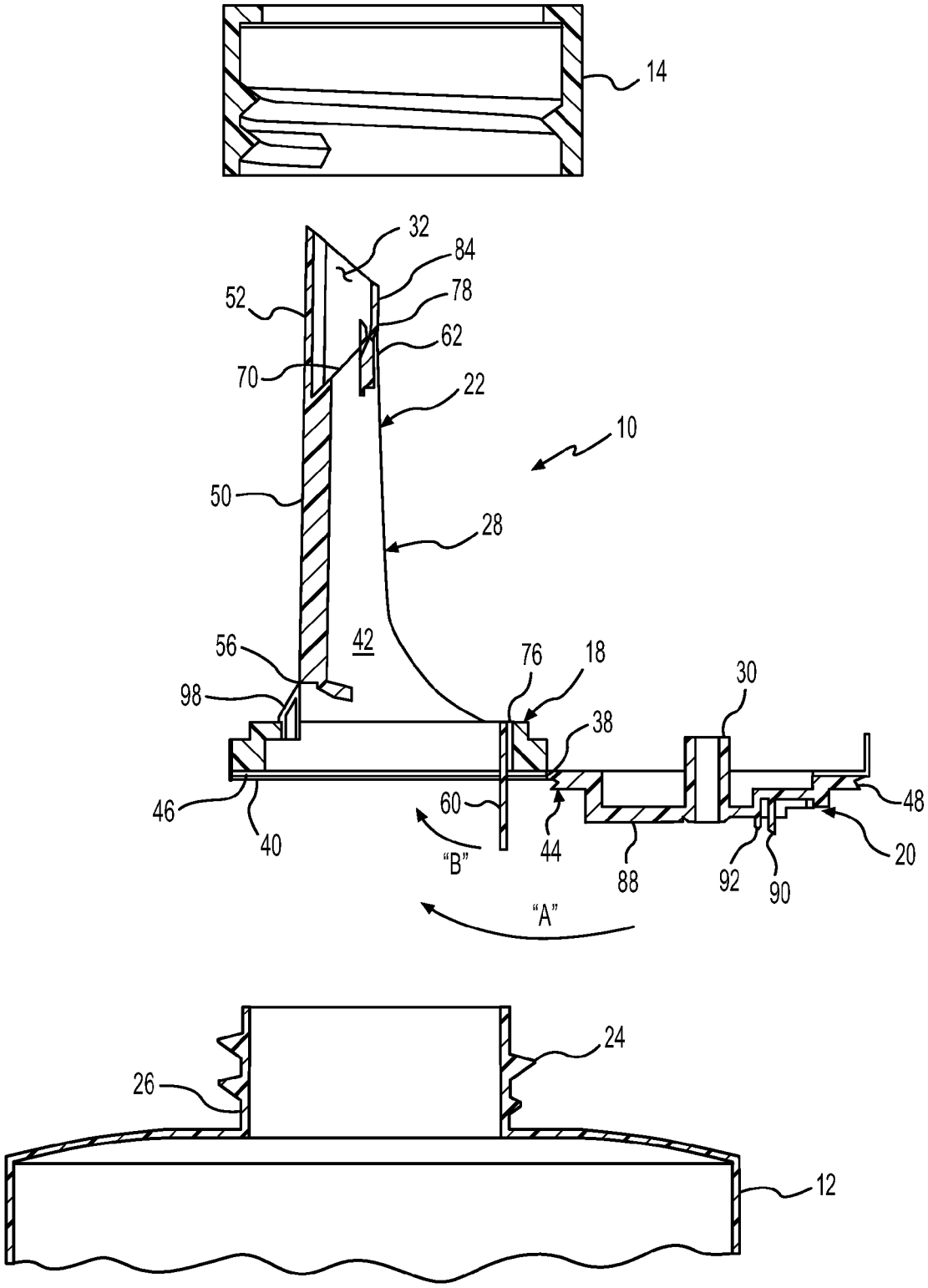
Figure 7:
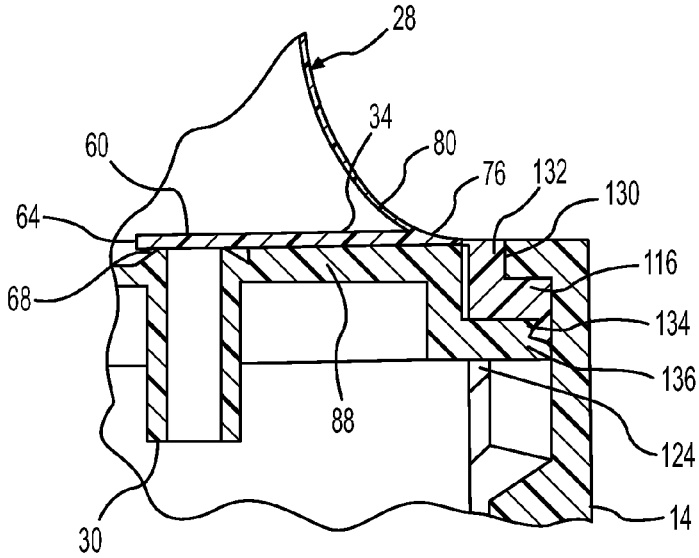
Figure 8:
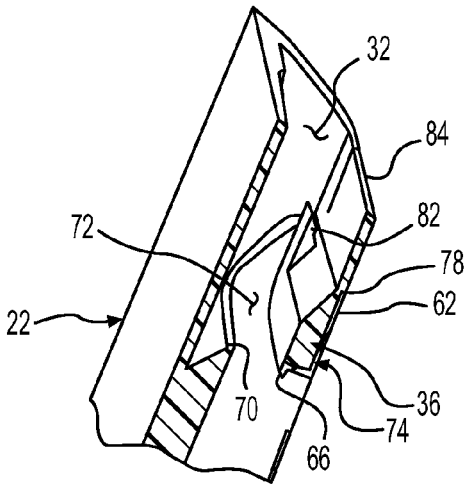
Figure 9:
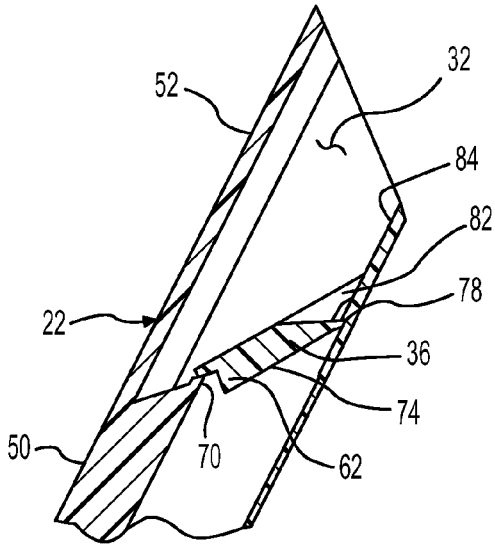

FIGS. 4, 5, and 6 are cross-sectional views of FIGS. 1, 2, and 3, respectively;

FIG. 7 is a cross-sectional detail view of an inlet check valve displaying the relationship of a reed, a cooperating seat, and a bridge;

FIGS. 8 and 9 are cross-sectional detail views of an upper outlet check valve in an as molded and as deployed configuration respectively.

Figure 10:
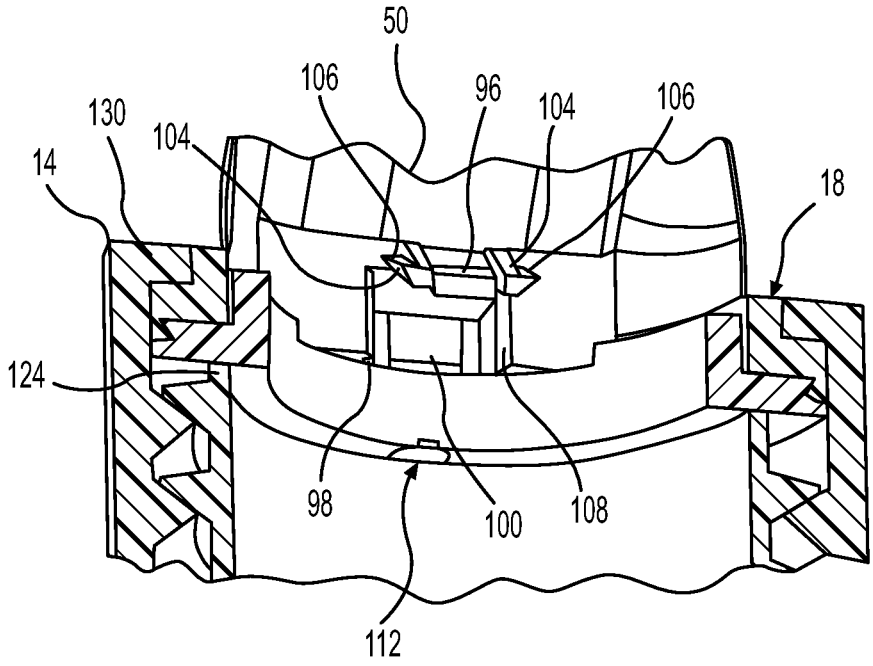
Figure 11:
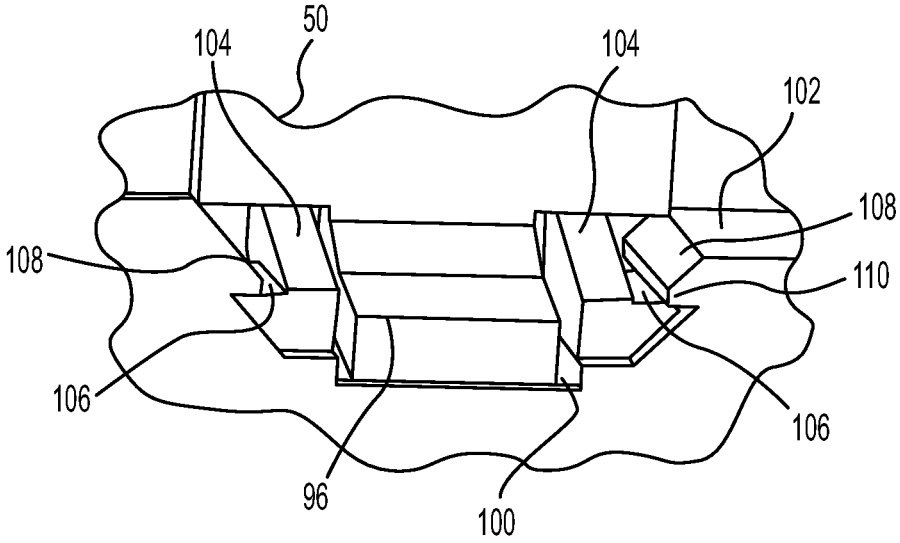

FIGS. 10 and 11 are views of the internal components or the dispenser in a ready and closed posture.

Figure 12:
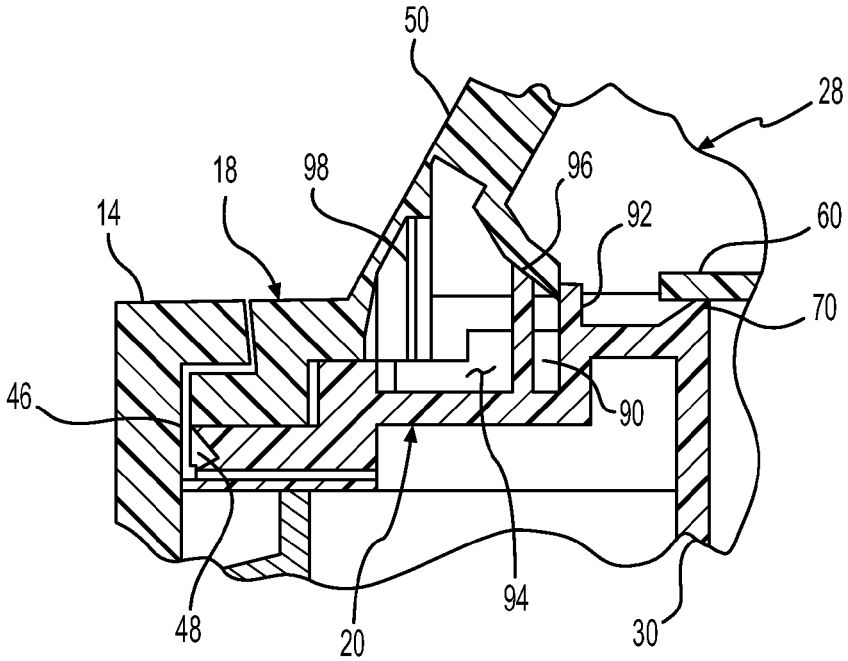

FIG. 12 is a cross-sectional representation of the relationship of a cap, a base, and a chamber floor with internal components.

Figure 13:
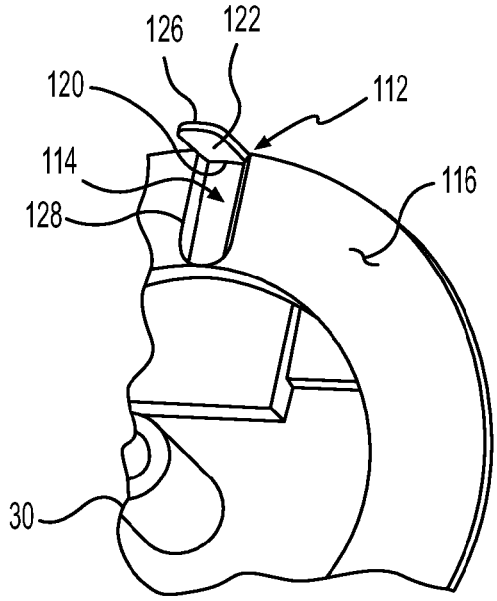

FIG. 13 is an axonometric view of a vent valve in a molded state; and

Figure 14:
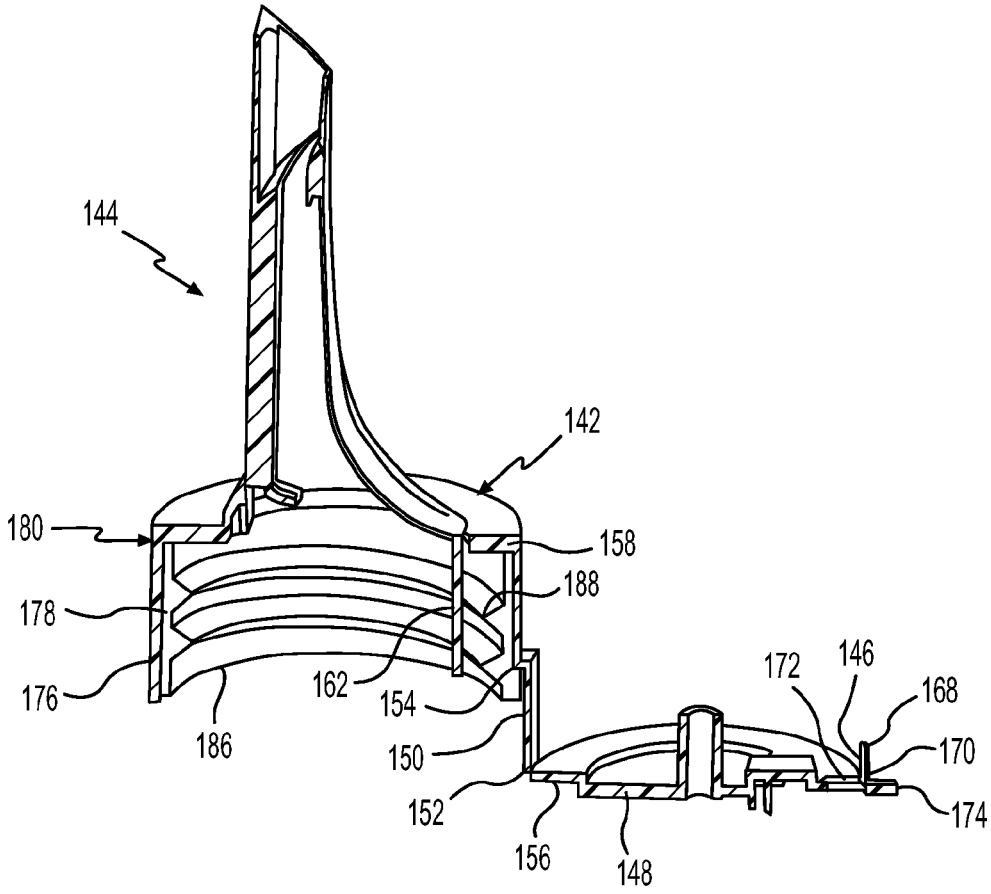
Figure 15:
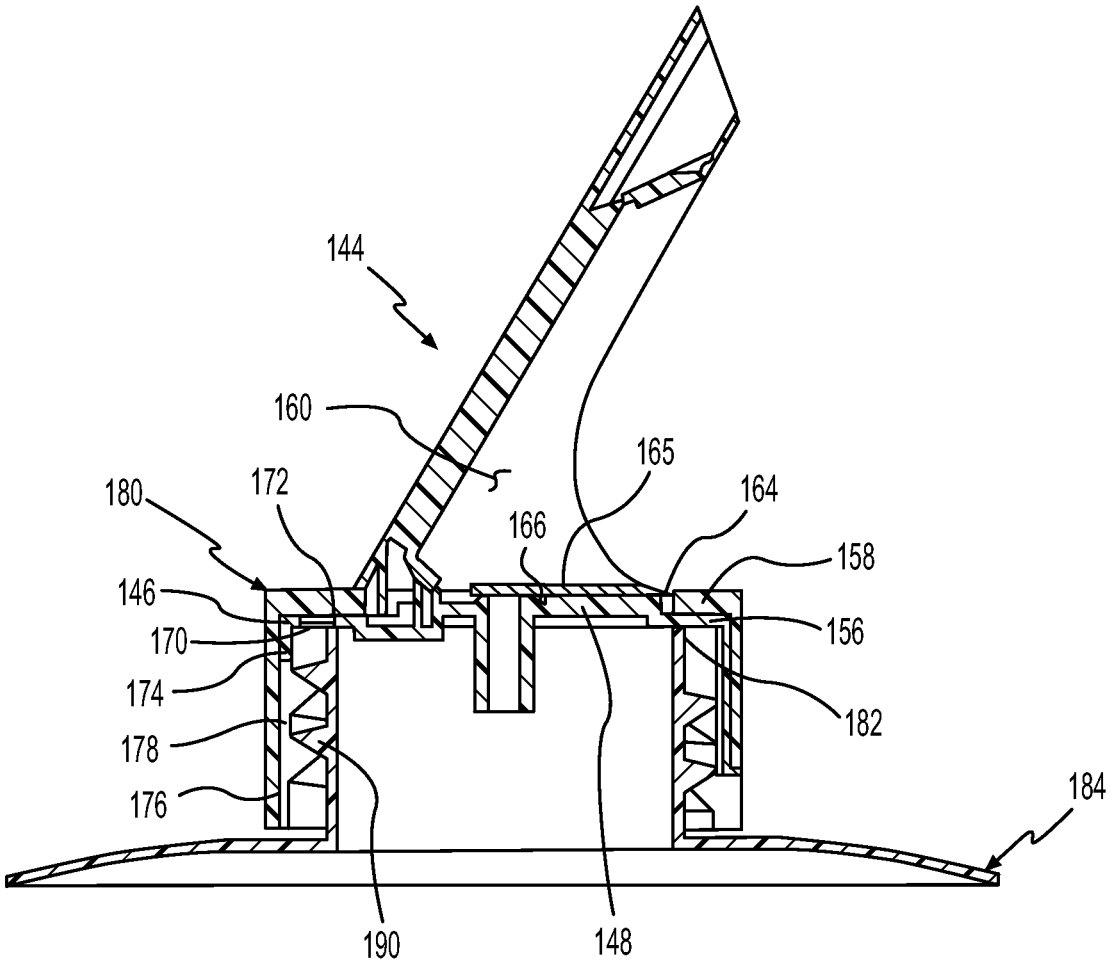

FIGS. 14 and 15 are cross-sectional views of an alternative preferred embodiment with the main variation being an integral molded cap with a spout.

DETAILED DESCRIPTION

Referring now particularly to the drawings, wherein like reference characters refer to like parts, and initially to FIG. 1, there will be seen an axonometric view of a deployable fluid dispenser 10 in accordance with a preferred embodiment of the invention. The dispenser 10 is shown secured to the top of a pressure-less container 12 in an upright or open posture ready for use. FIG. 2 shows the dispenser 10 with a body portion 16 in a fully collapsed position for storage, transport and on shelf sale.

FIG. 3 is an exploded view of the pump-action dispenser 10 that is broken away to illustrate its basic components in an as molded posture. The dispenser 10 is defined by three molded components: a base 18, a chamber floor 20, and a compressible spout 22. In a preferred embodiment these three components are all molded as an integral one piece unit. In this, during assembly the chamber floor 20 is pivoted counterclockwise in the direction of arrow "A" so that the chamber floor 20 is brought into intimate sealed engagement with the base 18. The dispenser 10 internally includes all the necessary components of an operating pump.

Separately molded in one embodiment is a sealing overcap 14 which permits full rotational orientation of the dispenser body 16 relative to the container 12. Internal threads (note FIG. 4) of the cap 14 cooperate with the external threads 24 of the container neck 26 to fascinate additional sealing abutment between the dispenser body base 18 and the chamber floor 20 of the molded fluid dispenser 10.

Cross-sectional views of FIGS. 1, 2, and 3 are shown by FIGS. 4, 5, and 6, respectively. In a preferred embodiment, the dispenser 10 defines a fluid pathway commencing with a dip tube 30, passing through a positive displacement pump, and exiting an outlet passageway 32. The compressible, pivotal spout 22 and the chamber floor 20 in cooperation with unidirectional inlet and outlet valves, 34 and 36 respectively, form a pump.

The chamber floor 20 is rotated about a living hinge 38 (note FIG. 6) to abut a base surface 40 completing a pump chamber 42. These components are held in sealed engagement by retaining element 44. The retaining element is composed from a tapered, base outer wall extension 46 fitting into a correspondingly tapered, retaining groove 48 encircling the chamber floor 20 with an upwardly clamping tension (note also FIGS. 6 and 12).

The pivotal spout 22 is defined by a rigid spout spine 50, a resiliently biased thin wall section 28, an upper collar 52, and an outlet passageway 32. As the spout 22 is pivotally depressed about a living hinge 56, a resiliently biased, thin, chamber wall 28 folds to reduce the internal volume of the spout chamber 42. This pressurizes and expels the spout chamber contents through a unidirectional outlet valve 36 and passageway 32. Once the spout 22 is released, the thin wall section 28 returns to an initial, resiliently biased configuration increasing the internal volume of the spout pump chamber 42. This reduces the internal pressure of the chamber and new material for dispensing is drawn up from the container 12 via dip tube 30 and an extension tube (not shown) that descends to the internal base of the container 12.

The fluid flow direction is controlled by uni-directional inlet and outlet check valves 34 and 36 respectively of the chamber 42. Enlarged cross-sectional views are provided by FIGS. 7, 8, and 9. The air-tight, pressure sensitive inlet valve 34 permits fluid to flow into the expanding pump chamber 42 when the pressure within the chamber falls below the adjoining container 12 and maintains the compression pressure generated by the folding pump chamber 42. The air-tight, pressure sensitive outlet valve 36 allows the discharge of the pressurized contents from the compressed pump chamber 42 and maintains the vacuum created by the expanding pump chamber 42. The valve sealing members are reeds 60 and 62 with free ends 64 and 66 abutting valve seats 68 and 70 to form air-tight seals. In a preferred embodiment these seats are elevated to enhance the air-tight seal in a viscous fluid flow environment. As these reeds 60 and 62 experience pressure differentials, the free ends 64 and 66 resiliently displace from the elevated valve seats 68 and 70 permitting fluid passage. The elevated seats 68 and 70 permit the reeds 60 and 62 to compress the dispensable material encircling the seats 68 and 70 to insure proper seals.

In one preferred embodiment, both reeds 60 and 61 are molded vertically and pivoted upwardly into position. In the case of the inlet reed 60, it is positioned by the chamber floor 20 as it is rotated into position in the direction of arrows "A" and "B" in FIG. 6. The outlet reed 62 is seated by pressing it through the valve seat opening 72 with the placement pad 74. The outlet valve seat 70 is integrally molded onto the upper spout collar 52. This collar 52 is a structural transition sustaining the thin wall 28 upper configuration and supporting the outlet valve 58 and passageway 32. Closing tensions are imparted on the reeds by their resiliently biased living hinges, 76 and 78.

The living hinge 76 of the inlet reed and the immediate surrounding thin wall region 80 are slightly thicker than the remaining thin wall region to ensure a sealing engagement with the valve seat 68 is maintained with the thin wall 28 movement. In addition to this tensioning, both reeds 60 and 62 must flex another structural component from rest when opening. The inlet reed 60 must flex the thin wall section 28 of the chamber and the tensioning foot 82 of the outlet reed 62 must flex the hinged lower wall 84 of the spout outlet 32 about living hinge 78. This enables the dispenser 10 to overcome plasticity concerning its valve reeds 60 and 62 tensioning components. When the dispenser 10 is closed there is a bridge 88 beneath the inlet reed 60 to prevent distortion resulting from vertical pressure from the folded thin wall member 28 (note FIG. 7).

Variations in material thickness of different components, depending on functionality, allow the use of a single material throughout the dispenser 10. The thin material thickness in the thin wall region 28 allows elastic flexibility for folding, whereas the comparatively thick spout spine 50 ensures rigidity. Selective variations in the material thickness of this thin region 28 are to provide adequate resiliency for the thin wall 28 to return to an initial biased resilient configuration once the pressure on the spout 22 is released. The operable posture angle "C" of the pivotal spout 22 is necessary to initiate downward movement when depressed.

In instances when dispensing high viscous materials and/or following a prolonged closed period the resiliently deformable portion of the thin chamber wall 28 may not be sufficiently resilient to reestablish the initial operable posture of the spout 22 following folding. In such case, extra resilience can be provided by an integral leaf spring stanchion component 90—see particularly FIGS. 6 and 12. Preferably this spring component 90 is a resiliently deformable stanchion within the chamber 42, which flexes when the chamber 42 is momentarily compressed and then urges the depressed spout 22 back to an upright operable posture. When dispenser 10 is either in the ready posture or totally compressed for storage or transporting this leaf spring element 90 is at rest. This and an additional stop stanchion 92 cooperate to maintain this desired, ready posture by overcoming the resilient biased nature of a molded part returning to its initial, resiliently biased molded form or an adopted compressed form due to plasticity after a prolonged closed period. These two stanchions, 90 and 92, are integrally molded onto the chamber floor 20 in recess 94.

A posture lever 96 at the base of the rigid spout spine 50 is entrapped between the leaf spring 90 and the stop stanchion 92 to maintain the angular "C" ready posture of the spout 22. The posture lever 96 is semi-rigid only allowing lateral movement to clear a latch 98 as the spout 22 is fully depressed. The two stanchions 90 and 92 cooperate with the posture lever 96 and all three exhibit a degree of operative flexibility to achieve the desired result. At full depression, this posture lever 96 rests in a like-formed recess 100 within the a support wall 102 as shown in FIG. 11. This posture lever 96 cooperates with the rigid spout spine 50 to limit the closure of the spout 22 preventing excess pressure on the thin wall 28 against the base 18 during storage or transporting. Alternately, a spring element may be positioned within recess 94 in the chamber floor 20 which is operable to receive an external spring element.

The dispenser 10 is held in a closed position by the internal latch 98 as shown in FIGS. 6, 11 and 12. Two latch levers 104 are formed at the base of the rigid spout spine 50 alongside and structurally similar to the posture of lever 96 with upward engaging surfaces 106 as revealed in FIGS. 10 and 11. Upon closing, these resiliently biased levers 104 slightly flex inwardly as they pass the inwardly sloped, leading surfaces 108 of the latch 98 which are integrally molded into the back support wall 102 as shown in FIG. 11. Preferably, abutting surfaces, 110 and 106, of these two details are flat and sufficient to releasably secure the dispenser 10 in the closed position. Alternatively, the posture and latch levers, 108 and 104, could be combined into one with some adaptations to the latch members 108 and 110 in the back support wall 102 to allow lateral flexing.

In a closed posture the inlet check valve 34 of the pumping chamber is held closed by the folded thin chamber wall 28 preventing release of any contents from the container 12, while the outlet check valve 36 is held closed by the resiliently deformable bottom spout wall 84 entrapping any remaining chamber contents. Both valve reeds 60 and 62 are in neutral positions with minimal closure pressures provided by their resiliently biased living hinges 76 and 78.

As shown in FIG. 13, a container venting valve 112 cooperates with a vent channel 114 on a base surface 116 to equalize internal and external pressure of the container 12 as fluid is drawn into the dispenser 10. This venting valve 112 is integrally molded onto the chamber floor surface and is pivotally positioned about a living hinge 120 when the chamber floor surface 118 is securely abutted against the dispenser body surface 40 and the leading mitered edge of the tapered wall extension 46 contacts a corresponding mitered edge of a vent reed 122. It is further secured by abutting the container lip 124, note FIG. 7, when dispenser 10 is affixed atop container 12. The valve free end 126 of resiliently biased reed 122 sealingly abuts an elevated valve seat 128 and flexes downward to balance the internal and external pressure of the container 12.

The dip tube 30 is integrally formed with the chamber floor 20 as noted above. A free end of the dip tube 30 is positioned anywhere within the container 12 depending on the manner in which the dispenser 10 is used. The dip tube 30 typically is fitted with an extension having a length sufficient to extend to a bottom corner of a tilted container 12 to retrieve all of the fluid contents. Alternately, the pick-up tube may be affixed over the inlet nipple or inserted into a recess and held with friction. Ultrasonic or thermal welding or applying an adhesive may be additional securing options for a dip tube extension.

A tapered, snap retainer wall 130, note FIG. 10, flanking the over-cap 14 opening snaps onto a complementing tapered wall of the spout 22 to maintain the pump body assembly 16 when the over-cap 14 is loosened as shown in FIG. 7. Once the spout orientation is determined, tightening the over-cap 14 further secures the sealing abutment of the base surface 40 with an upper chamber floor surface 134 and a lower chamber floor surface 136 with the container lip 124.

The dispenser 10 may be formed from a number of suitable materials such as for example polypropylene or polyethylene. The material needs to be resilient and flexible to enable the resilient folding of at least a portion of the body to facilitate compression of the chamber 42. The extent of the elastic flexibility of the plastic in any given area dependents on the thickness of the area. Thick sections provide structural rigidity to support resiliently thinner sections and functional movement.

FIGS. 14 and 15 represent cross-sectional views of an alternative embodiment molded entirely as one part. FIG. 14 reveals a cross-sectional view of a disposable dispenser and FIG. 15 is the embodiment in a molded form. The functioning features are identical with the prior embodiment with the exceptions of an internally threaded cap 142 which is integrally molded with the dispenser body 110 and the container vent 146 configuration.

The chamber floor 148 of this embodiment pivots with extension arm 150 about living hinges 152 and 154 to abut with dispenser body 144 at surfaces 156 and 158 respectively. This rotation completes the pump chamber 160 and positions an inlet valve reed 162 about a living hinge 164 atop the elevated valve seat 166. This pivoting also positions a vent valve reed 168 about living hinge 170 on the elevated vent valve seat 172 when positioning foot 174 of the reed 168 contacts an inner surface 176 of a vent channel 178 within the threads 142 of the integrally molded cap 180. The reed 168 positioning is finished upon contacting the container lip as the dispenser 140 is affixed atop the container 184.

The threads 188 of the integral cap 180 in cooperation with the complementing threads 190 of the container 184 sealingly secure the chamber floor 148 to the dispenser body 144.

In describing preferred embodiments of the invention it will be appreciated that the spout body 22 itself in cooperation with inlet 34 and outlet 36 check valves comprises a functioning fluid pump In the subject application reference has been made to the term "living hinge." In this application applicant is using the term in a conventional sense of a relatively thin flexible web of plastic material that joins two relatively ridged bodies together. A living hinge made with polyethylene or polypropylene usually never fail. In the subject application a plastic elastic hinge that is capable of flexing hundreds of times should be sufficient although it is envisioned that in certain circumstances that a fully elastic hinge capable of flexing thousands of times will be used or where a shorter life span is satisfactory a living hinge can be composed a fully plastic hinge which is capable of flexing only a few cycles may be sufficient.

In the specification the expression "approximately" is intended to mean at or near and not exactly such that the exact location is not considered critical.

In the claims reference has been made to use of the term "means" followed by a statement of function. When that convention is used applicant intends the means to include the specific structural components recited in the specification and the drawings and in addition other structures and apparatus the will be recognized by those of skill in the art as equivalent structures for performing the recited function and not merely structural equivalents of the structures as specifically shown and described in the drawings and written specification.

In describing the invention, reference has been made to preferred embodiments. Those skilled in the art, however, and familiar with the disclosure of the subject invention may recognize additions, deletions, substitutions, modifications and/or other changes which will fall within the purview of the invention as defined in the following claims.

What is claimed is:

1. A molded fluid pump dispenser operable to be connected to a non-pressurized fluid container, said molded fluid pump dispenser comprising:

a base;

a pump chamber floor connected to said base and being operable to pivot from a connected molded condition into flush engagement with said base wherein, a fluid inlet port extends through said pump chamber floor, and an inlet check valve is pivotally connected to said chamber floor and operably covers said fluid inlet port to permit one way flow of fluid from a container of fluid through said inlet check valve; and a compressible pump chamber spout having, a rigid spine connected to said base by a living hinge, a relatively thin wall section connected to said spine and circumferentially jointed to said base, said thin wall section in cooperation with said rigid spine forming a pump chamber spout, and an outlet check valve molded internally into approximately a distal end of said pump chamber spout wherein said chamber floor having an inlet check valve, said pump chamber spout having a rigid spine and a thin wall pump chamber section and said outlet check valve forming a pump chamber fluid spout, wherein upon pivoting of said pump chamber fluid spout by said rigid spine about said living hinge said pump chamber fluid spout collapses said relatively thin wall section between said pump chamber floor and said spine to expel fluid within the interior of said pump chamber fluid spout past said outlet check valve and out of said pump chamber fluid spout and then returning said rigid spine to a generally upright posture with a generally empty pump chamber fluid spout resulting in an interior pump chamber fluid spout pressure being less than ambient pressure which induces fluid at approximately ambient pressure within a container to push through said inlet check valve to refill said pump chamber fluid spout with fluid to be dispensed.

2. A molded fluid pump dispenser operable to be connected to a non-pressurized fluid container as defined in claim 1 and further comprising:

a posture lever connected to said rigid spine of said pump chamber fluid spout and biasing said pump chamber fluid spout into a generally upright posture, and a leaf spring stanchion component molded with said pump chamber floor and being operable to be engaged by said posture lever.

3. A molded fluid pump dispenser operable to be connected to a non-pressurized fluid container as defined in claim 2 and further comprising:

a stop stanchion integrally molded with said pump chamber floor and being operable to cooperate with said posture lever and said leaf spring stanchion to maintain a ready posture of said pump dispenser.

4. A molded fluid pump dispenser operable to be connected to a non-pressurized fluid container as defined in claim 1 and further comprising:

a container venting valve connected to said molded fluid dispenser and being operable to equalize internal and external pressure of a container connected to said molded fluid pump dispenser.

5. A molded fluid pump dispenser operable to be connected to a non-pressurized fluid container as defined in claim 1 wherein:

said fluid inlet port has an elevated rim with respect to said pump chamber floor; and said inlet check valve is pivotally molded to said pump chamber floor by a living hinge.

6. A molded fluid pump dispenser operable to be connected to a non-pressurized fluid container as defined in claim 1 wherein:

said outlet check valve is pivotally molded within approximately a distal end of said pump chamber fluid spout by a living hinge in a posture within said pump chamber fluid spout generally opposed to said rigid spine.

7. A molded fluid pump dispenser operable to be connected to a non-pressurized fluid container as defined in claim 6 wherein:

a seat for said outlet check valve is molded into an interior portion of said rigid spine.

8. A molded fluid pump dispenser operable to be connected to a non-pressurized fluid container, said molded fluid pump dispenser comprising:

a base;

a pump chamber floor connected to said base and being operable to pivot from a connected molded condition into flush engagement with said base wherein, a fluid inlet port extends through said pump chamber floor, and an inlet check valve is pivotally connected to said chamber floor and operably covers said fluid inlet port to permit one way flow of fluid from a container of fluid through said inlet check valve; and a compressible pump spout having, a rigid spine connected to said base by a living hinge, a relatively thin wall pump chamber section connected to said spine and circumferentially jointed to said base, said thin wall pump chamber section in cooperation with said rigid spine forming a pump chamber fluid spout, and an outlet check valve molded internally into approximately a distal end of said pump chamber fluid spout wherein said pump chamber floor having an inlet check valve, said pump chamber fluid spout having a rigid spine and a thin wall pump chamber section and said outlet check valve forming a pump chamber fluid spout, and means for biasing said pump chamber fluid spout in a generally upright posture wherein upon pivoting of said pump chamber fluid spout by said rigid spine about said living hinge said pump chamber fluid spout collapses said relatively thin wall pump chamber section between said chamber floor and said spine to expel fluid within the interior of said pump chamber fluid spout past said outlet check valve and out of said pump chamber fluid spout and then returning said rigid spine to a generally upright posture with a generally empty pump chamber fluid spout resulting in an interior pump chamber fluid spout pressure being less than ambient pressure which induces fluid at approximately ambient pressure within a container to push through said inlet check valve to refill said pump chamber fluid spout chamber with fluid to be dispensed.

9. A molded fluid pump dispenser operable to be connected to a non-pressurized fluid container as defined in claim 8 wherein said means for biasing comprises:

a posture lever connected to said rigid spine of said pump chamber fluid spout and biasing said pump chamber fluid spout into a generally upright posture, and a leaf spring stanchion component molded with said pump chamber floor and being operable to be engaged by said posture lever.

10. A molded fluid pump dispenser operable to be connected to a non-pressurized fluid container as defined in claim 9 and further comprising:

a stop stanchion integrally molded with said pump chamber floor and being operable to cooperate with said posture lever and said leaf spring stanchion to maintain a ready posture of said dispenser.

11. A molded fluid pump dispenser operable to be connected to a non-pressurized fluid container as defined in claim 10 and further comprising:

a container venting valve connected to said molded fluid dispenser and being operable to equalize internal and external pressure of a container connected to said molded fluid pump dispenser.

12. A molded fluid pump dispenser operable to be connected to a non-pressurized fluid container as defined in claim 11 wherein:

said fluid inlet port has an elevated rim with respect to said pump chamber floor; and said inlet check valve being pivotally molded to said pump chamber floor by a living hinge.

13. A molded fluid pump dispenser operable to be connected to a non-pressurized fluid container as defined in claim 12 wherein:

said outlet check valve is pivotally molded within approximately a distal end of said spout by a living hinge in a posture within said spout generally opposed to said rigid spine.

14. A molded fluid pump dispenser operable to be connected to a non-pressurized fluid container as defined in claim 13 wherein:

a seat for said outlet check valve is molded into an interior portion of said rigid spine.

15. A molded fluid pump dispenser operable to be connected to a non-pressurized fluid container, said molded fluid dispenser comprising:

a base;

a pump chamber floor operably connected to said base in flush engagement with said base wherein, a fluid inlet port extends through said pump chamber floor, and an inlet check valve is pivotally connected to said pump chamber floor and operably covers said fluid inlet port to permit one way flow of fluid from a container of fluid through said inlet check valve; and a compressible pump chamber fluid spout having, a rigid spine connected to said base by a living hinge, a relatively thin wall section connected to said spine and circumferentially jointed to said base, said thin wall section in cooperation with said rigid spine forming a pump chamber fluid spout, and an outlet check valve molded internally into approximately a distal end of said pump chamber fluid spout wherein said chamber floor having an inlet check valve, said pump chamber fluid spout having a rigid spine and a thin wall section and said outlet check valve forming a pump chamber fluid spout, wherein upon pivoting of said pump chamber fluid spout by said rigid spine about said living hinge said pump chamber fluid spout collapses said relatively thin wall section between said pump chamber floor and said spine to expel fluid within said interior pump chamber fluid spout past said outlet check valve and out of said pump chamber fluid spout and then returning said rigid spine to a generally upright posture with a generally empty pump chamber fluid spout resulting in an interior pump chamber fluid spout pressure less than ambient pressure which induces fluid at approximately ambient pressure within a container to push through said inlet check valve to refill said pump chamber fluid spout with fluid to be dispensed.

16. A molded fluid pump dispenser operable to be connected to a non-pressurized fluid container as defined in claim 15 and further comprising:

a posture lever connected to said rigid spine of said pump chamber fluid spout and biasing said spout into a generally upright posture, and a leaf spring stanchion component molded with said pump chamber floor and being operable to be engaged by said posture lever; and a stop stanchion integrally molded with said pump chamber floor and being operable to cooperate with said posture lever and said leaf spring stanchion to maintain a ready posture of said dispenser.

17. A molded fluid pump dispenser operable to be connected to a non-pressurized fluid container as defined in claim 16 and further comprising:

a container venting valve connected to said molded fluid pump dispenser and being operable to equalize internal and external pressure of a container connected to said molded fluid pump dispenser.

18. A molded fluid pump dispenser operable to be connected to a non-pressurized fluid container as defined in claim 16 wherein:

said fluid inlet port has an elevated rim with respect to said pump chamber floor; and said inlet check valve is pivotally molded to said pump chamber floor by a living hinge.

19. A molded fluid pump dispenser operable to be connected to a non-pressurized fluid container as defined in claim 18 wherein:

said outlet check valve is pivotally molded within approximately a distal end of said pump chamber fluid spout by a living hinge in a posture within said pump chamber fluid spout generally opposed to said rigid spine.

20. A molded fluid pump dispenser operable to be connected to a non-pressurized fluid container as defined in claim 19 and further comprising:

a tensioning foot molded upon said outlet check valve.

21. A molded fluid pump dispenser operable to be connected to a non-pressurized fluid container as defined in claim 19 wherein:

a seat for said outlet check valve is molded into an interior portion of said rigid spine.

* * * * *